US010153122B2

(12) United States Patent
Yoon et al.

(10) Patent No.: US 10,153,122 B2
(45) Date of Patent: Dec. 11, 2018

(54) TEMPERATURE-SENSITIVE PELLET TYPE THERMAL FUSE

(71) Applicants: DONG-YANG ELECTRONICS CO., LTD., Gwangju-si, Gyeonggi-do (KR); Sung Woong Yoon, Seoul (KR)

(72) Inventors: Sung Woong Yoon, Seoul (KR); Min Gon Kim, Taean-gun (KR)

(73) Assignees: DONG-YANG ELECTRONICS CO., LTD, Gwangju-si (KR); Sung Woong Yoon, Seoul (KR)

( * ) Notice: Subject to any disclaimer, the term of this patent is extended or adjusted under 35 U.S.C. 154(b) by 0 days.

(21) Appl. No.: 15/415,259

(22) Filed: Jan. 25, 2017

(65) Prior Publication Data

US 2017/0345602 A1 Nov. 30, 2017

(30) Foreign Application Priority Data

May 25, 2016 (KR) ..... 10-2016-0063954

(51) Int. Cl.

*H01H 85/06* (2006.01)
*H01H 85/10* (2006.01)
*H01H 85/17* (2006.01)
*H01H 37/76* (2006.01)

(52) U.S. Cl.

CPC ..... *H01H 85/06* (2013.01); *H01H 85/10* (2013.01); *H01H 85/17* (2013.01); *H01H 37/765* (2013.01); *H01H 2037/762* (2013.01)

(58) Field of Classification Search

CPC ..... H01H 37/764–37/767; H01H 2037/762; H01H 85/0047; H01H 85/06; H01H 85/10; H01H 85/17; H01H 85/36

USPC ..... 337/407–409, 416

See application file for complete search history.

(56) References Cited

U.S. PATENT DOCUMENTS 3,274,361 A * 9/1966 Ebensteiner ..... H01H 37/765 337/148
3,944,960 A * 3/1976 Audette ..... H01H 37/765 337/408
4,126,845 A 11/1978 Iimori et al.
4,276,532 A * 6/1981 Aoki ..... H01H 37/765 337/407
4,281,308 A * 7/1981 McVey ..... H01H 37/765 337/407

(Continued)

FOREIGN PATENT DOCUMENTS

JP 2002-042620 A 2/2002
KR 101435955 B1 9/2014

*Primary Examiner* — Anatoly Vortman
*Assistant Examiner* — Jacob R Crum
(74) *Attorney, Agent, or Firm* — Sughrue Mion, PLLC

(57) ABSTRACT

A temperature-sensitive pellet type thermal fuse having a cylindrical metal case (11), a first lead (1) fixedly installed and insulated from the case (11) and a second lead (2) electrically connected to the case (11). A temperature-sensitive pellet (12) is installed by melting inside the case (11) and has a variable height. A moving terminal (16) is elastically coupled by a first spring (17) to the temperature-sensitive pellet (12) and an activating member (15) moves in a height decrease direction of the temperature-sensitive pellet (12) by an elastic repulsive force of a second spring (18). When the temperature-sensitive pellet (12) is melted and thereby is reduced in height, a first moving contact (16*b*) of the moving terminal (16) is separated from a first contact (1*a*) of the first lead (1).

3 Claims, 5 Drawing Sheets

(56) References Cited

U.S. PATENT DOCUMENTS

| | | | | | |
|---|---|---|---|---|---|
| 4,305,202 | A * | 12/1981 | Plasko | H01H 37/765 | 29/622 |
| 4,309,685 | A * | 1/1982 | Candor | H01H 37/765 | 337/408 |
| 4,326,186 | A * | 4/1982 | Clay | H01H 37/765 | 337/107 |
| 4,401,965 | A * | 8/1983 | Backlund | H01H 37/765 | 337/407 |
| 5,530,417 | A * | 6/1996 | Hohider | H01H 1/06 | 200/239 |
| 5,612,663 | A * | 3/1997 | Hollweck | H01H 37/002 | 337/150 |
| 2010/0219929 | A1* | 9/2010 | Lee | H01H 37/765 | 337/182 |
| 2012/0182116 | A1* | 7/2012 | Van Beneden | H01H 37/767 | 337/147 |
| 2013/0057382 | A1* | 3/2013 | Yen | H01H 37/765 | 337/414 |

* cited by examiner

TEMPERATURE-SENSITIVE PELLET TYPE THERMAL FUSE

BACKGROUND OF THE INVENTION

Field of the Invention

The present invention relates to a temperature-sensitive pellet type thermal fuse, and more particularly, to a temperature-sensitive pellet type thermal fuse in which when a periphery temperature or a circuit temperature rises to a predetermined level or higher, a temperature-sensitive pellet inside a cabinet is melted so that a moving terminal elastically supported by a spring and a lead wire are attached to or detached from each other, thereby allowing a circuit to be turned on or off.

Description of the Related Art

A thermal fuse is a component detecting an abnormal overheat of an apparatus and promptly shutting off a circuit of the apparatus, and is used in various fields such as automotive parts of a vehicle, various home appliances, portable electronic communication devices, office equipments, vehicle-loaded automotive parts, AC adapters, chargers, motors and batteries.

The thermal fuse employs, as a temperature-sensitive material, a pellet type molded with an organic material which is generally melted at a predetermined fuse activation temperature. The thermal fuse has been known by the disclosure in multiple documents including the following patent documents.

PRIOR ART DOCUMENTS

Patent Documents (Patent document 1) KR10-1202434 B1

(Patent document 2) U.S. Pat. No. 5,530,417 B1

In the case of a conventional thermal fuse disclosed in the patent document 1, when a support unit is melted in an activation temperature range, a moving terminal selectively conducting a first contact connected to a first lead wire and a first contact (an inner wall of a metal case) connected to a second lead wire is moved in a direction separating the contacts by force of a spring pressing and holding the support unit to electrically short-circuit the first and second contacts, so that a circuit is switched off.

However, in the conventional thermal fuse, the moving terminal instantly short-circuits the first and second contacts at a moment when a second spring force acting in a direction separating the moving terminal from the second contact becomes greater than a first spring force acting in a direction making the moving terminal contact the first contact, i.e. a moment when the support unit being melted is decreased to a predetermined height, so the conventional thermal fuse has a structure in which a switch operation is sensitive to the change in the height of the support unit.

Accordingly, since the structure is such that a cut-off operation is sensitive to a minute difference between acting forces of the two springs or a tiny reduction of the temperature-sensitive pellet, there has been a limitation that a malfunction of shutting off the circuit happens when an unintended shrinkage deformation occurs in the temperature-sensitive pellet in a lower temperature range less than the predetermined activation temperature range. Since the conventional thermal fuse having the structure sensitively reacts against periphery temperature changes, there has been a limitation in that operation of the conventional thermal fuse is unstable.

Besides, since the conventional thermal fuse has the structure in which one end of the moving terminal in an outer perimeter direction thereof contacts the inner wall surface of the metal case in a line contact state, there has been a limitation in that, when the force of the spring elastically supporting the moving terminal is not evenly applied to the moving terminal, the moving terminal is deflected in any one direction to be caught by the inner wall of the case and causing malfunction by being unable to perform a slide movement.

SUMMARY OF THE INVENTION

Accordingly, the present invention is directed to a temperature-sensitive pellet type thermal fuse that substantially obviates one or more problems due to limitations and disadvantages of the related art, the temperature-sensitive pellet type thermal fuse having high operation reliability and accurately operating in a predetermined temperature range without malfunction owing to stable contact or separation performance between contacts.

Embodiments of the present invention provide a temperature-sensitive pellet type thermal fuse including: a cylindrical metal case; a first lead fixedly installed on one end of the case to be insulated from the case by an insulating bushing; a second lead electrically connected to the other end of the case; a temperature-sensitive pellet installed inside the case and having a height varied while being melted at a predetermined temperature or higher; and a moving terminal, one end of which is elastically supported by a first spring to the temperature-sensitive pellet, and a moving terminal electrically separating the first lead and the second lead from each other in accordance with height decrease of the temperature-sensitive pellet, wherein the temperature-sensitive pellet type thermal fuse further includes: an activating member moving in a height decrease direction of the temperature-sensitive pellet by an elastic repulsive force of a second spring acting toward the temperature-sensitive pellet when the temperature-sensitive pellet is melted and thereby is reduced in height, and actuating the moving terminal, from a time point when the temperature-sensitive pellet is reduced in height to a predetermined height, such that a first moving contact of the moving terminal is separated from a first fixed contact of the first lead.

In one aspect of the present invention, the thermal fuse according to an embodiment of the present invention may include a fixed terminal plate provided inside the case and under the insulating bushing and contacting the case so as to be electrically connected to each other, and having a hole perforated coaxially with a through-hole of the insulating bushing, wherein the moving terminal may be slidingly guided into the hole of the fixed terminal plate, and an inner wall of the hole may serve as a second fixed contact electrically connecting the first fixed contact of the first lead and the case at the second lead side while slidingly contacting an outer circumferential surface of the moving terminal until the temperature-sensitive pellet arrives at an activation height at which a switch is turned off.

In one aspect of the present invention, the moving terminal may have a head part provided on a lower end of a body and expanded at a relatively greater diameter than the diameter of the body, the first spring may be compressedly installed between a lower surface of the head part of the moving terminal and an upper surface of a base plate placed on an upper surface of the temperature-sensitive pellet, the activating member may have a through hole defined in an upper end sidewall thereof such that the body of the moving terminal passes therethrough, a lower surface of the upper end sidewall may contact an upper surface of the head part of the moving terminal when the height change amount of the temperature-sensitive pellet arrives at a predetermined level, and the activating member may move the moving terminal when the temperature-sensitive pellet is excessively melted beyond the predetermined level specified as the height change amount of the temperature-sensitive pellet.

In one aspect of the present invention, the base plate may have a hole such that, when the temperature-sensitive pellet is melted, a melted portion of the temperature-sensitive pellet is introduced in the inside of the activating member.

In one aspect of the present invention, the case may have a stepped portion formed at a border between an upper region having a relatively greater inner diameter and a lower region having a relatively less inner diameter, the fixed terminal plate may be placed on and fixed by the stepped portion of the case, and the insulating bushing may be placed on and fixed by an upper surface of the fixed terminal plate.

Additional advantages and features of the invention will be set forth in part in the description which follows and in part will become apparent to those having ordinary skill in the art upon examination of the following or may be learned from practice of the invention.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. Hereinafter, a temperature-sensitive pellet type thermal fuse according to embodiments of the present invention will be described in detail with reference to accompanying drawings.

Figure 1:
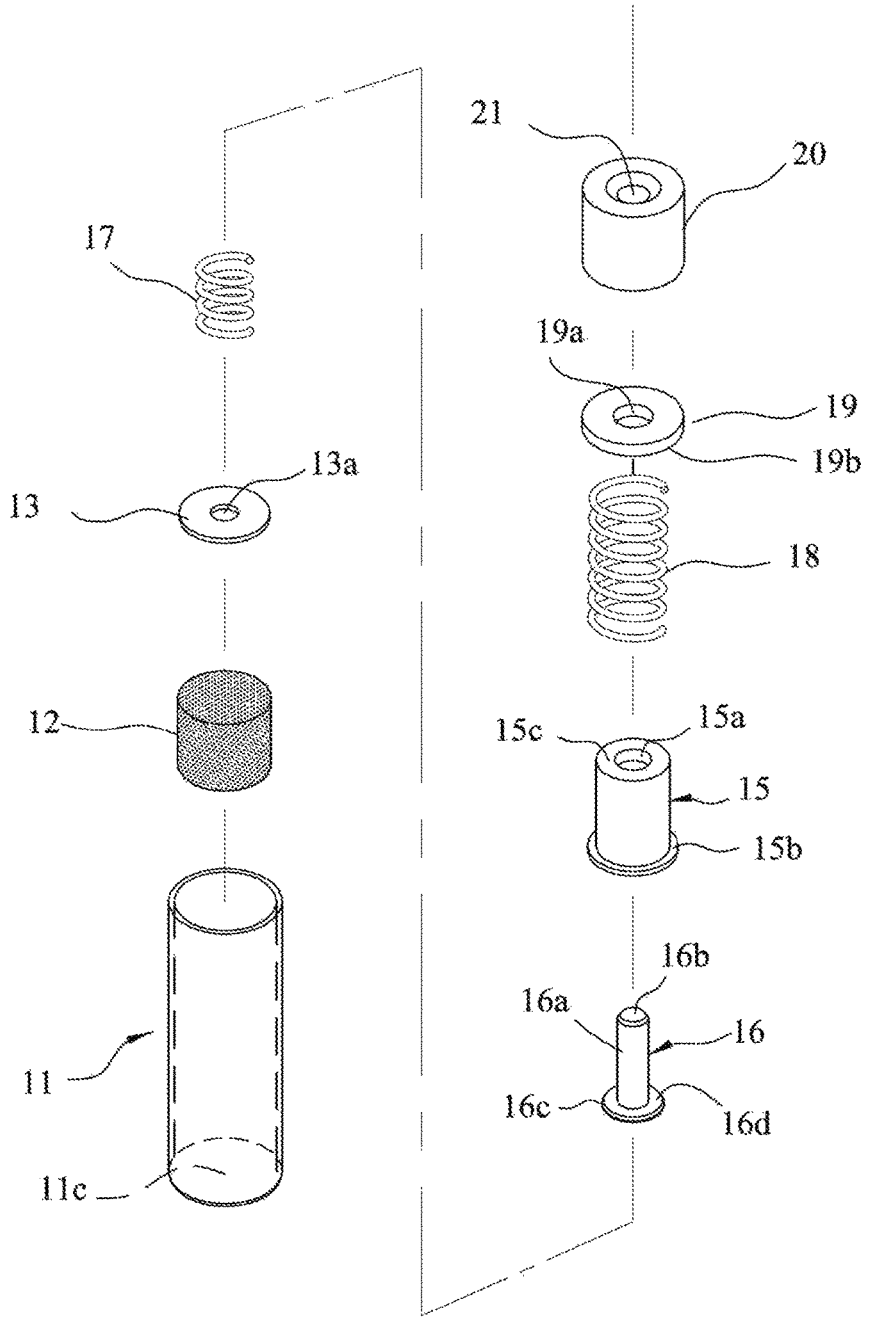
FIG. 1 is an exploded perspective view schematically illustrating an overall configuration of a temperature-sensitive pellet type thermal fuse according to an embodiment of the present invention.
Figure 2:
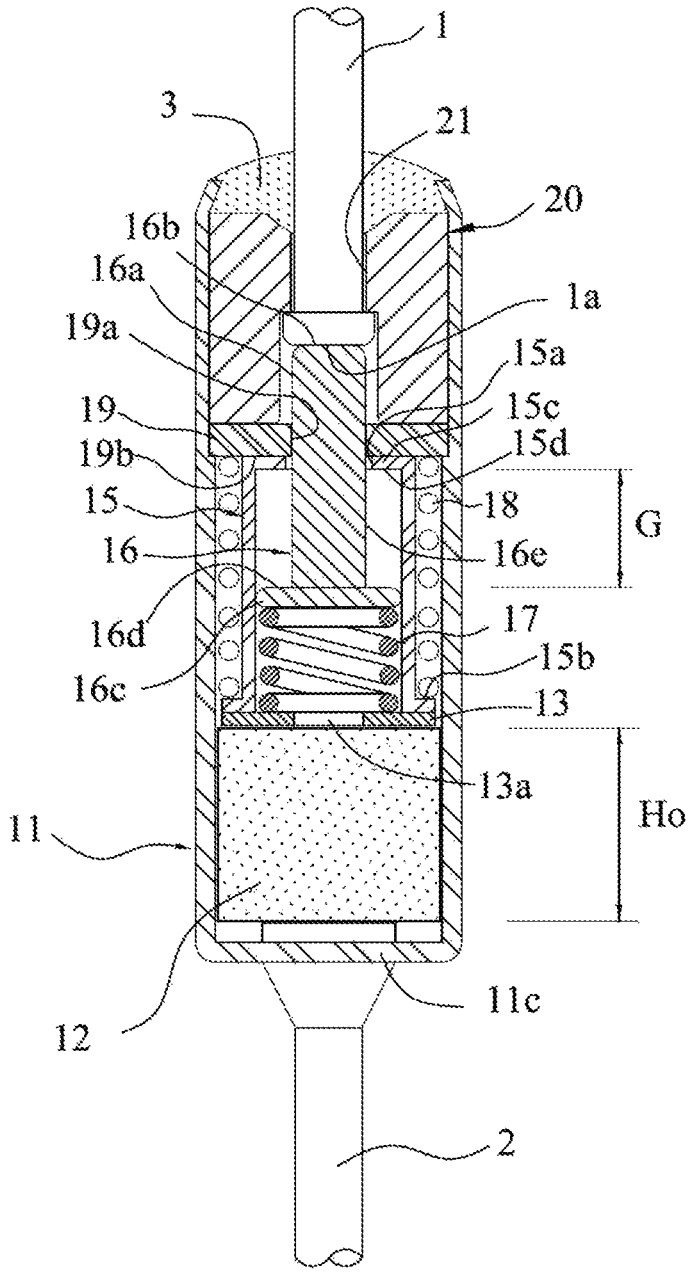
FIG. 2 is a cross-sectional assembly view in a longitudinal direction of a temperature-sensitive pellet type thermal fuse according to an embodiment of the present invention when temperatures inside and outside a case are in a switched on state.

As shown in FIGS. 1 and 2, a temperature-sensitive pellet type thermal fuse according to an embodiment of the present invention includes a metal case 11, one end of which is opened while the other end has a floor 11*c*. The case 11 is divided into an upper region having a relatively greater inner diameter and a lower region having a relatively less inner diameter, and a stepped portion is defined on a border of the upper and lower regions.

In the lower region of the case 11, a temperature-sensitive pellet 12, a base plate 13, a first spring 17, a moving terminal 16, an activating member 15 and a second spring 18 are insertedly installed in a sequential manner from the floor 11*c* side of the case 11, and in the upper region of the case 11, a fixed terminal plate 19 and an insulating bushing 20 are insertedly provided in a sequential manner.

The fixed terminal plate 19 is preferably provided in a disc type made of metal. The fixed terminal plate 19 is placed on and fixed by the stepped portion while contacting an inner wall surface of the case 11 along a perimeter of a side surface so as to be electrically connected to the case 11. The fixed terminal plate 19 has a hole 19*a* such that the moving terminal 16 moves in a central axis direction while slidingly contacting the hole 19*a*. Thus, the fixed terminal plate 19 is electrically connected to the case 11 by contacting the inner wall surface of the case 11 and/or the stepped portion, and is also electrically connected to the moving terminal 16 slidingly contacting the hole 19*a*, and at the same time, the fixed terminal plate 19 also serves a role to guide the moving terminal 16, so that the moving terminal 16 moves while slidingly contacting an inner wall of the hole 19*a*.

Figure 5:
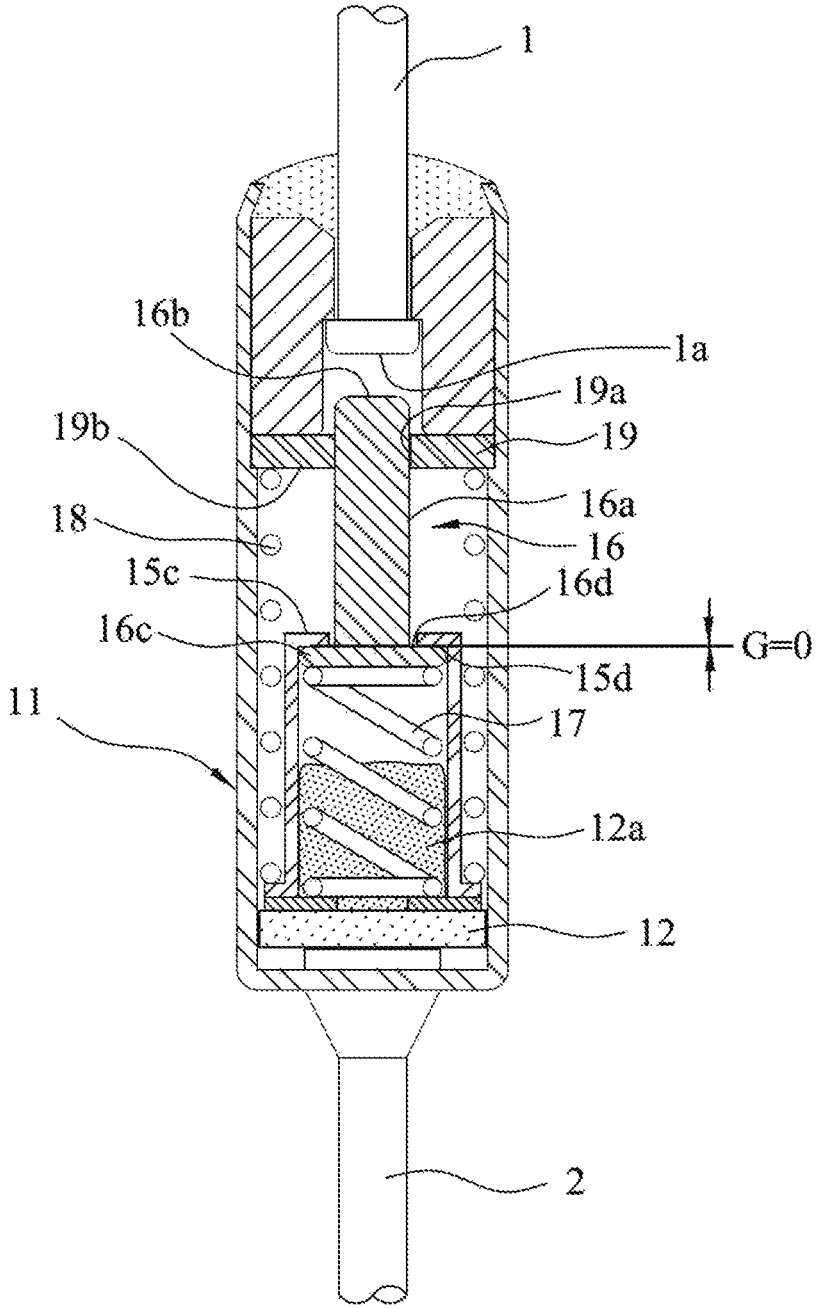
FIG. 5 is a cross-sectional assembly view in a longitudinal direction of the temperature-sensitive pellet type thermal fuse in a state when the moving terminal is separated from the first lead.

The temperature-sensitive pellet 12 is made by compressing and molding a non-conductive organic material in a pellet shape. The temperature-sensitive pellet 12 has an initial height H0, and is installed to be loaded on the floor 11*c* inside the cabinet 11, and as illustrated in FIG. 5, when a periphery temperature of the case 11 is equal to or greater than a predetermined preset activation temperature (a switch off activation temperature that a thermal fuse shuts off a circuit), the temperature-sensitive pellet 12 is melted and reduced in height to a predetermined height H2 or less at which the switch performs a shut off operation.

A first lead 1 passes through a through-hole 21 of the insulating bushing 20, such that one end of which extends to the outside of the case 11 while a surface of the other end provides a first fixed contact 1*a* inside the through-hole 21. On the floor 11*c* of the case 11, a second lead 2 is electrically connected to the case 11 while facing the first lead 1. An opened upper side of the insulating bushing 20 is sealed with a sealing material 3.

Figure 3:
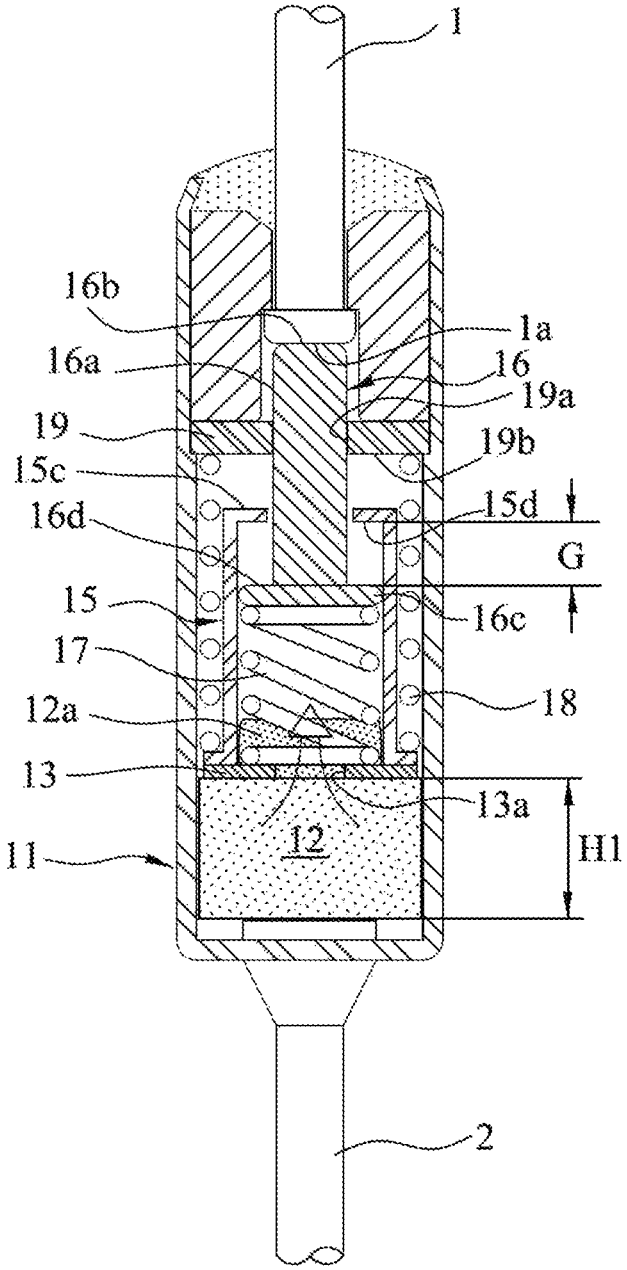
FIG. 3 is a cross-sectional assembly view in a longitudinal direction of the temperature-sensitive pellet type thermal fuse at an initial state that melting of the temperature-sensitive pellet begins.

The moving terminal 16 has, on one end, a first moving contact 16*b* contacting a first fixed contact 1*a* of the first lead 1 and, on the other end, a head part 16*c* expanded at a relatively greater diameter than the diameter of a body 16*a*. As illustrated in FIGS. 2 and 3, the moving terminal 16 having the aforementioned structure is installed such that the body 16*a* passes through the hole 19*a* of the fixed terminal plate 19 to be slidingly guided on an inner surface of the hole 19*a*, and the head part 16*c* expanded in a relatively greater diameter than the diameter of the body 16*a* is provided on a lower end of the body 16*a*. The moving terminal 16 is elastically supported by the first spring 17 compressedly installed between a lower surface of the head part 16*c* and an upper surface of the temperature-sensitive pellet 12. That is, at least until the temperature-sensitive pellet 12 is melted and is reduced in height to a predetermined level or less, the first spring 17 elastically supports the lower surface of the head part 16*c* of the moving terminal 16 such that the first moving contact 16*b* of the moving terminal 16 remains in contact with the first fixed contact 1*a* of the first lead 1.

The base plate 13 is disposed between the first spring and the temperature-sensitive pellet 12 so as to stably support one end of the first spring 17 even in the case that the temperature-sensitive pellet 12 is deformed by molten deformation or damage. The base plate 13 has a hole 13*a* such that a melted portion 12*a* may escape therethrough when the temperature-sensitive pellet 12 is deformed by being melted.

The thermal fuse according to an embodiment of the present invention has the activating member 15 configured to separate a first moving contact 16*b* of the moving terminal 16 from the first fixed contact 1*a* of the first lead 1 such that a switch performs an off operation when the temperature-sensitive pellet 12 is melted, in accordance with the rise of the periphery temperature, and is reduced in height from the initial height H0 to a predetermined height H2 or less at which the switch performs an off operation.

The activating member 15 is provided in a cylindrical shape having an opened lower end, an upper end having an upper end sidewall 15*c*, and a spring support step 15*b* on an outer surface of the lower end. The activating member 15 is placed on and supported by the base plate 13 and receiving the moving terminal 16 and the first spring 17 in an internal space thereof, wherein the body 16*a* of the moving terminal 16 passes through a through-hole 15*a* of the upper end sidewall 15*c* to extend towards the first lead 1, and the head part 16*c* is elastically supported by the first spring 17 in the internal space of the activating member 15. The second spring 18 having a relatively greater modulus of elasticity than the first spring 17 is elastically installed on the outside of the activating member 15 to elastically deflect the activating member 15 towards the temperature-sensitive pellet 12 in response to a height decrease due to melting of the temperature-sensitive pellet 12.

As illustrated in FIGS. 2 and 3, when the temperature-sensitive pellet 12 is melted and is reduced in height, the activating member 15 moves towards the temperature-sensitive pellet 12 by an elastic repulsive force of the second spring 18 elastically installed between a lower surface 19*b* of the fixed terminal plate 19 and the spring support step 15*b*, and when the temperature-sensitive pellet 12 is reduced in height to a predetermined height H2 or less, the activating member 15 moves the moving terminal 16 in a state in which a lower surface 15*d* of the upper end sidewall 15*c* remains in contact with the upper surface 16*d* of the head part 16*c* of the moving terminal 16, and separates the first moving contact 16*b* of the moving terminal 16 from the first fixed contact 1*a* of the first lead 1 to turn the switch off.

As described above, when the moving terminal 16 moves in the same direction as a sliding movement direction of the activating member 15 by interlocking with a sliding movement of the activating member 15, the moving terminal 16 is guided by the body 16*a* slidingly contacting an inner wall of the hole 19*a* of the fixed terminal plate 19, so it is possible to prevent a phenomenon in which the moving terminal 16 is tilted and caught by an inner wall of the case to cause a malfunction.

Hereinafter, an operating mechanism of the thermal fuse according to an embodiment of the present invention will be described with reference to the accompanying drawings.

Normal State: Switched on State (FIGS. 2 and 3)

As illustrated in FIG. 2, if the periphery temperature of the case 11 is equal to or less than a predetermined fuse activation temperature, the temperature-sensitive pellet 12 is not melted, so the temperature-sensitive pellet 12 is not changed in height. Thus, the moving terminal 16 maintains a contact state between the first moving contact 16*b* and the first fixed contact 1*a* of the first lead 1 by a spring force of the first spring 17, and an outer surface of the body 16*a* of the moving terminal 16 maintains a contact state with the inner wall of the hole 19*a* of the fixed terminal plate 19 connected to the case 11. That is, in the state exhibited in FIG. 2, the first lead 1 is electrically connected to the second lead 2 through a path of the moving terminal 16—the fixed terminal plate 19—the case 11, and thus a switch on state is maintained.

From the state exhibited in FIG. 2, when the temperature-sensitive pellet 12 is partially melted and is reduced in height as the temperature rises, and before a height H1 of the temperature-sensitive pellet 12 is reduced to the height H2 at which the switch substantially initiates operation (H1>H2), as illustrated in FIG. 3, the temperature-sensitive pellet 12 is reduced in height due to melting of the temperature-sensitive pellet 12, and the base plate 13 is also accordingly lowered by the height reduction amount (H0−H1) of the temperature-sensitive pellet 12. Thereby, while the second spring 18 expands and pushes the activating member 15 away such that the activating member is in close contact with the temperature-sensitive pellet 12, the first spring 17 pushes the moving terminal 16 up in an opposite direction, and thus the first moving terminal contact 16*b* of the moving terminal 16 maintains a close contact state with the first fixed contact 1*a* of the first lead 1.

Figure 4:
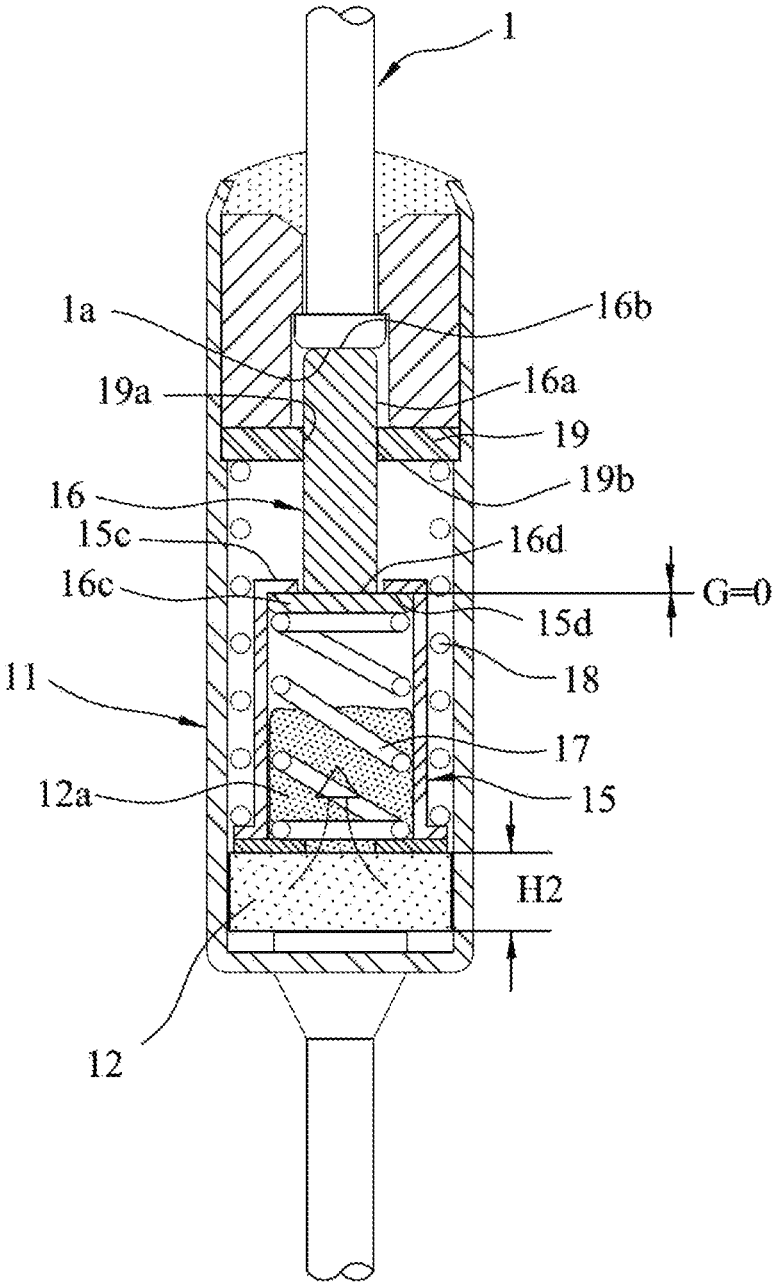
FIG. 4 is a cross-sectional assembly view in a longitudinal direction of the temperature-sensitive pellet type thermal fuse in a state right before a moving terminal is separated from a first lead.

Switched Off State (FIGS. 4 and 5)

The temperature-sensitive pellet 12 is continuously melted as the periphery temperature rises, and is continuously reduced in height, and accordingly, the activating member 15 also moves towards the floor 11*c* of the case 11. However, after a time point (G=0) when the lower surface 15*d* of the upper-end sidewall 15*c* of the activating member 15 contacts the upper surface 16*d* of the head part 16*c* of the moving terminal 16, the activating member 15 moves the moving terminal 16 towards the temperature-sensitive pellet 12 by the force of the second spring 18, which is greater than the force of the first spring 17, to separate the first moving contact 16*b* from the first fixed contact 1*a* of the first lead, and thus a switch off operation is performed.

While the activating member 15 moves the moving terminal 16 for the switch off operation, the body 16*a* of the moving terminal 16 is linearly guided while sliding into the hole 19*a* of the fixed terminal plate 19, thus the moving terminal 16 performs a linear movement without shaking, and thus it is possible to prevent an inoperability or malfunction in that the moving terminal 16 is deflected in any one direction and caught by the inner wall of the case due to an uneven force of the spring which gives a moving force when the moving terminal 16 moves for the switch off operation.

According to the configuration set forth herein, when the moving terminal moves in accordance with melting of the temperature-sensitive pellet, the moving terminal is guided along the inner wall surface of the hole of the fixed terminal plate, and a separation of the moving terminal from the fixed contact is stably performed, so the switch operation is accurately performed within the predetermined temperature range without malfunction.

Also, the switching operation is performed only when the temperature-sensitive pellet is melted and deformed by a predetermined amount by rise of the periphery temperature without being directly affected by deformation of the temperature-sensitive pellet caused by unexpected factors such as external vibration or impact, thereby ensuring high operation reliability.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A temperature-sensitive pellet type thermal fuse comprising:

a cylindrical metal case (11);

a first lead (1) fixedly installed on one end of the case (11) to be insulated from the case (11) by an insulating bushing (20) and having a first fixed contact (1*a*) at said one end in the case (11);

a second lead (2) electrically connected to the other end of the case (11);

a temperature-sensitive pellet (12) installed inside the case (11) and having an initial height (H0), and being melted at a predetermined temperature to a switch-off activation height (H2) where a switch-off activation occurs;

a fixed terminal plate (19) having a hole (19*a*) and fitted in the case (11) under the insulating bushing (20) so that an outer surface of the fixed terminal plate (19) is in contact with the case (11) to be electrically connected thereto;

a moving terminal (16) having a body (16*a*) through the hole (19*a*) of the fixed terminal plate (19) and being in contact with an inner wall surface of the hole (19*a*), a first moving contact (16*b*) provided at an upper end of the body (16*a*) and being in contact with the first fixed contact (1*a*), and a head portion (16*c*) of bigger diameter than the body (16*a*) at a lower end of the body (16*a*);

a first spring (17) installed compressively between the bottom surface of the head portion (16*c*) and the temperature-sensitive pellet (12) to force the head portion (16*c*) upward against the first fixed contact (1*a*);

an activating member (15) having a side wall, an upper end sidewall (15*c*) having a through-hole (15*a*), an inner space defined by the side wall and the upper end sidewall (15*c*) and a spring support step (15*b*) provided on an outer surface of a lower end thereof, the activating member (15) being movably placed between the fixed terminal plate (19) and the temperature-sensitive pellet (12), and accommodating the head portion (16*c*) of the moving terminal (16) and the first spring (17) in the inner space to allow the body (16*a*) of the moving terminal (16) to extend outwardly through the through-hole (15*a*); and a second spring (18) installed compressively between the fixed terminal plate (19) and the spring support step (15*b*) to force the activating member (15) to be on the temperature-sensitive pellet (12) and develop a gap (G) between the upper end sidewall (15*c*) of the activating member (15) and the head portion (16*c*) of the moving terminal (16);

wherein until the temperature-sensitive pellet (12) is melted to arrive at the switch-off activation height(H2), the activating member (15) moves alone by spring force of the second spring (18) in the direction of pellet height decrease, without moving the moving terminal (16), so that the first moving contact (16*b*) of the moving terminal (16) can be maintained in contact with the first contact (1*a*) of the first lead (1) and the body (16*a*) of the moving terminal (16) can be maintained in non-sliding contact with the hole (19*a*) of fixed terminal plate (19), wherein when the pellet (12) is melted to arrive at the switch-off activation height (H2), the upper end sidewall (15*c*) of the activating member (15) moves the moving terminal (16) to separate the first moving contact (16*b*) of the moving terminal (16) from the first contact (1*a*) of the first lead (1), and wherein the activating member (15) moves the moving terminal (16) to separate the first moving contact (16*b*) of the moving terminal (16) from the first contact (1*a*) of the first lead (1) when the pellet (12) is melted to the switch-off activation height (H2) or less.

2. The temperature-sensitive pellet type thermal fuse according to claim 1, further comprising a base plate (13) having a hole (13*a*) such that, when the temperature-sensitive pellet (12) is melted, a melted portion (12*a*) of the temperature-sensitive pellet (12) is introduced in the inside of the activating member (15).

3. The temperature-sensitive pellet type thermal fuse according to claim 1, wherein the case (11) has a stepped portion on the inner wall thereof, and wherein the fixed terminal plate (19) is placed on and fixed by the stepped portion of the case (11), and the insulating bushing (20) is placed on and fixed by an upper surface of the fixed terminal plate (19).

* * * * *